US006663086B2

(12) United States Patent
Huang

(10) Patent No.: US 6,663,086 B2
(45) Date of Patent: Dec. 16, 2003

(54) STRUCTURE OF A CABLE WINCH USED IN VEHICLE

(76) Inventor: Yuan-Hsiang Huang, PO Box 82-144, Taipei (TW)

( * ) Notice: Subject to any disclaimer, the term of this patent is extended or adjusted under 35 U.S.C. 154(b) by 1 day.

(21) Appl. No.: 10/015,772

(22) Filed: Dec. 17, 2001

(65) Prior Publication Data

US 2003/0111654 A1 Jun. 19, 2003

(51) Int. Cl.[7] ..... B66D 1/22
(52) U.S. Cl. ..... 254/344
(58) Field of Search ..... 254/323, 345, 254/346, 344, 365

(56) References Cited

U.S. PATENT DOCUMENTS 3,055,237 A * 9/1962 Magnuson ..... 475/296
4,452,429 A * 6/1984 Muessel ..... 254/344
4,461,460 A * 7/1984 Telford ..... 254/344
4,545,567 A * 10/1985 Telford et al. ..... 254/344
4,736,929 A * 4/1988 McMorris ..... 254/344
4,834,341 A * 5/1989 Baum ..... 254/375

FOREIGN PATENT DOCUMENTS

GB 2048201 * 12/1980 ..... 254/345

* cited by examiner

*Primary Examiner*—Emmanuel Marcelo
(74) *Attorney, Agent, or Firm*—Leong C. Lei

(57) ABSTRACT

An improved structure of a cable winch used in vehicle is disclosed. The present cable winch provides the user to turn the control button to position a protruded peg at the top edge of the through hole of the gear box, and the control button will pull the transmission shaft and the moving gear thereon and the worm-like spring, thereby the moving gear disengages from the teeth portion of the rolling cylinder and the rolling cylinder is unloaded and rotates freely, and the cable of the winch can be rapidly and conveniently pulled out.

1 Claim, 11 Drawing Sheets

STRUCTURE OF A CABLE WINCH USED IN VEHICLE

BACKGROUND OF THE INVENTION (a) Technical Field of the Invention

The present invention relates to a winch, and in particular, a winch which can control the disengagement of a speed-reducing device and motor from a rolling cylinder such that the rolling cylinder is rotated without load and the cable of the winch can be manually pulled out conveniently.

(b) Description of the Prior Art

FIGS. 1, 2 and 2A show a conventional winch structure, wherein on one side of the rolling cylinder 11 a first gear box 12 and a rotating knob 13 and the first gear box 12 makes use of a transmission shaft 14 to mount in sequence a pushing plate 131, a first sun gear 121, two planetary gear sets 122. The rolling cylinder 11 has a second gear box 15 and a motor 16. In this conventional structure, if the cable 112 on the rolling cylinder 111 is pulled manually, the rolling cylinder 111 is engaged in sequence with the first gear set 122 and therefore the pulling of the cable is laborious and the speed of pulling is rather slow. Further, the gears may sometime in engagement when pulling of the cable which further causes time-consuming during the process of pulling.

Accordingly, it is an object of the present invention provide an improved structure of a cable winch used in vehicle which mitigate the above drawbacks.

SUMMARY OF THE INVENTION

Accordingly, it is an object of the present invention to provide an improved structure of a cable winch used in vehicle, wherein when the user turns the control button to position a protruded peg at the top edge of the through hole of the gear box, the control button will tow the transmission shaft and the moving gear thereon and the worm-like spring, thereby the moving gear disengages from the teeth portion of the rolling cylinder and the rolling cylinder is unloaded and rotates freely, and the cable of the winch can be rapidly and conveniently pulled out.

One aspect of the present invention is to provide an improved structure of a cable winch used in vehicle, comprising a rolling cylinder component having one end being mounted with a gear speed-reducing device and the other end being mounted with a motor so as to transmit the power of the motor to the rolling cylinder component by the gear speed-reducing device, and the speed-reducing device including a control button, a transmission shaft, a gear box, a sun gear, a plurality of planetary gear sets, a clutch and planet gear set, and a fastening ring, characterized in that the interior of the control button is provided with a protruded tubular section and the center of the tubular section is provided with an inner hole, and the circumferential edge thereof is arranged with protruded pegs;

the transmission shaft is a hexagonal rod body having one end being inserted into the inner hole of the control button using the fastening ring and a recessed ring is provided close to the middle section thereof;

the bottom surface of the gear box is provided with a through hole and the inner circumferential edge of the through hole is provided with a recess to match with the protruded peg of the control button;

the clutch and planet gear set includes a planet gear train 361, a front cover, a moving gear, a worm-like spring, and a fixing board, and the center of the front cover is pressed into a protruded section surrounded with teeth hole and the board surface of the front cover is provided with an engaging hole and by means of the fixing board to mount the moving gear and the worm-like spring so that the moving gear is extendable and retractable within the protruded section of the front cover;

the surface of the fixing board is provided with crooked leg to correspond with the engaging hole of the front cover so that the moving gear and the worm-shaped gear are mounted on the front cover; and the center of the rotating shaft of the motor is provided a polygonal insertion hole with external diameter substantially the same as the transmission shaft, the transmission shaft is inserted into the inner hole of the control button and is locked with the fastening ring, and the tubular section of the control button is inserted at the position of the through hole of the gear box and the protruded peg of the control button is in alignment with the recess of is the gear box and the transmission shaft is extended to the center of the gear box and in sequence the transmission shaft is mounted with the pad, the sun gear, a plurality of planetary gear set and the clutch and planet gear set, thereby in releasing the cable, the control button is pulled and turned so that the protruded peg urges the top edge of the through hole of the gear box and the button pulls the transmission shaft and the fastening ring compresses the moving gear and the worm-like spring so that the moving gear disengages with the teeth section of the rolling cylinder, and the rolling cylinder is dislocated from the clutch and planet gear set and rotates freely, and the cable is retracted rapidly and conveniently Other object and advantages of this invention will become more readily appreciate as the same becomes understood by reference to the following detailed description.

DETAILED DESCRIPTION OF THE PREFERRED EMBODIMENT

Figure 1:
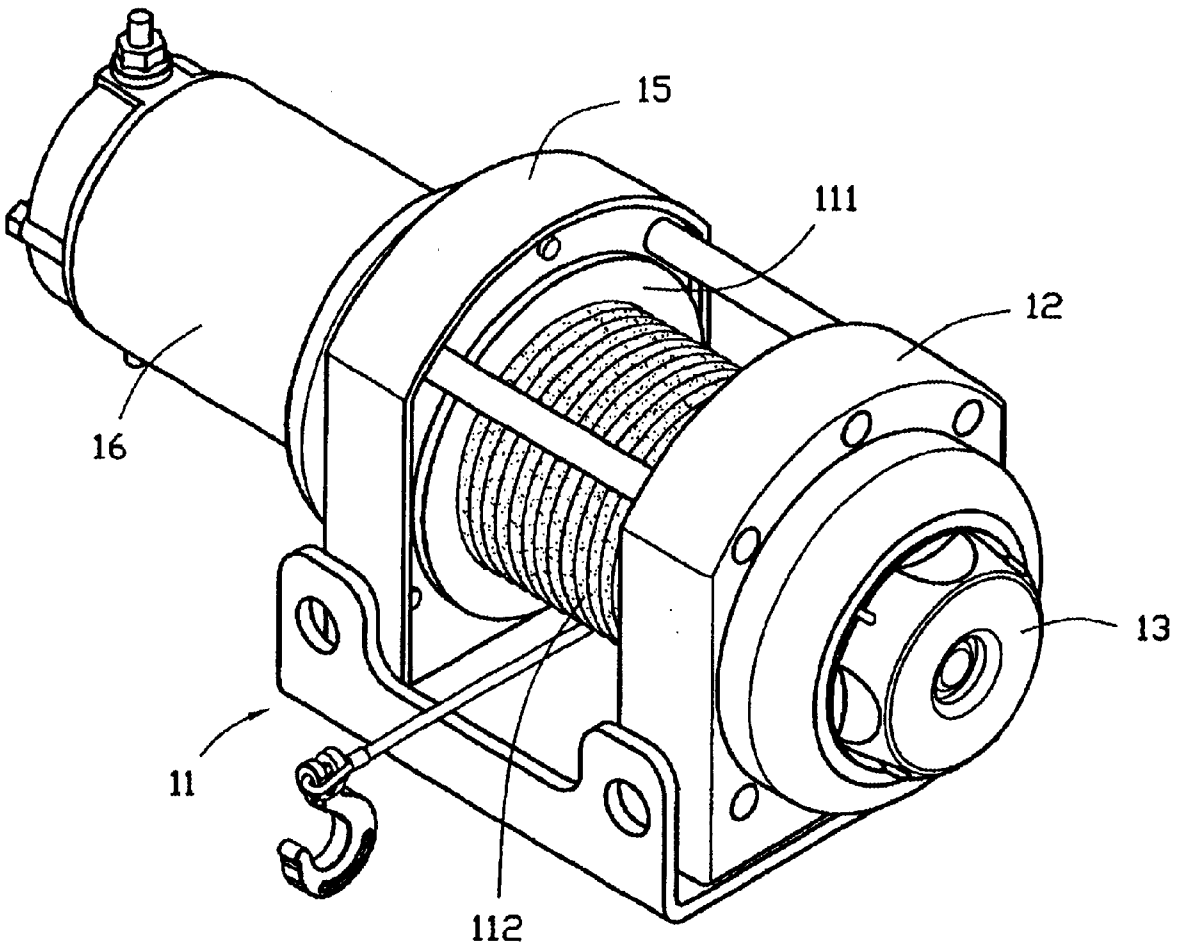
PRIOR ART FIG. 1
FIG. 1 is a perspective view of a conventional winch.
Figure 2A:
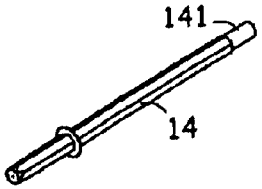
PRIOR ART FIG. 2A
FIG. 2A is a perspective view of the transmission shaft.
Figure 2:
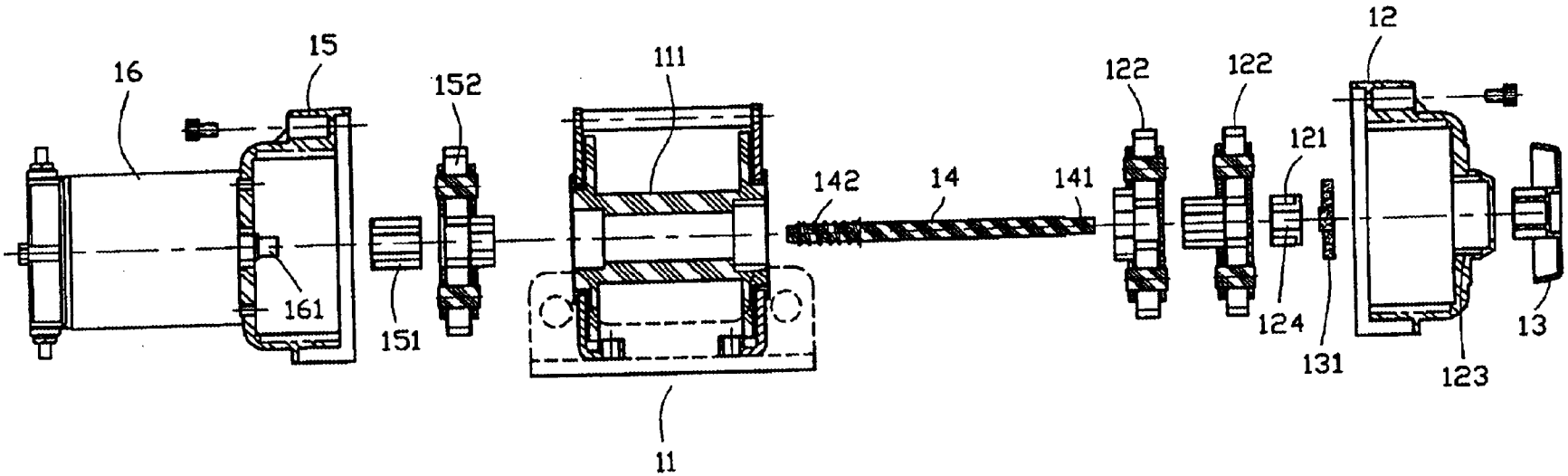
PRIOR ART FIG. 2
FIG. 2 is a sectional exploded view of the conventional winch.
Figure 3:
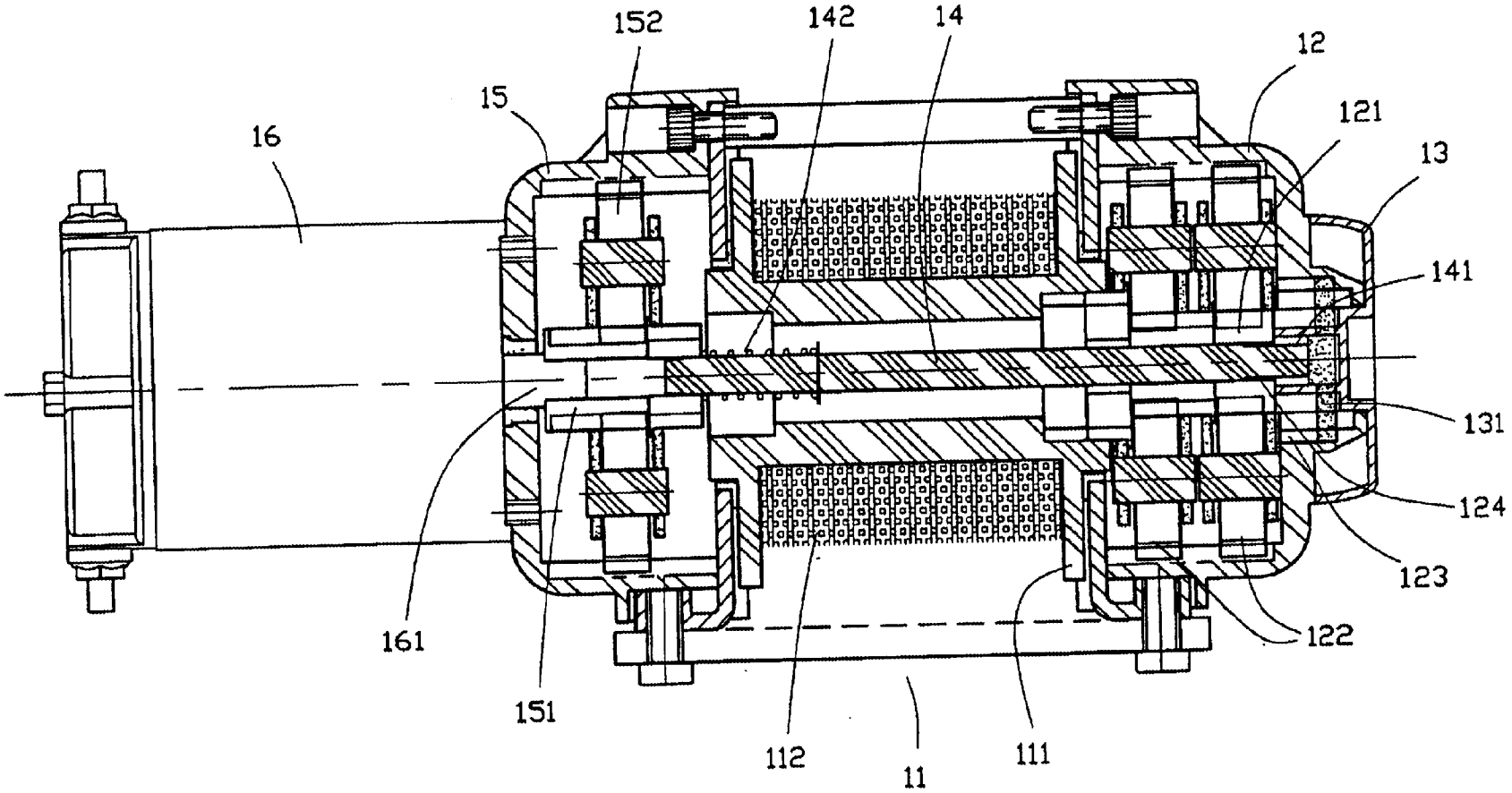
PRIOR ART FIG. 3
FIG. 3 is a sectional view of the conventional winch.
Figure 4:
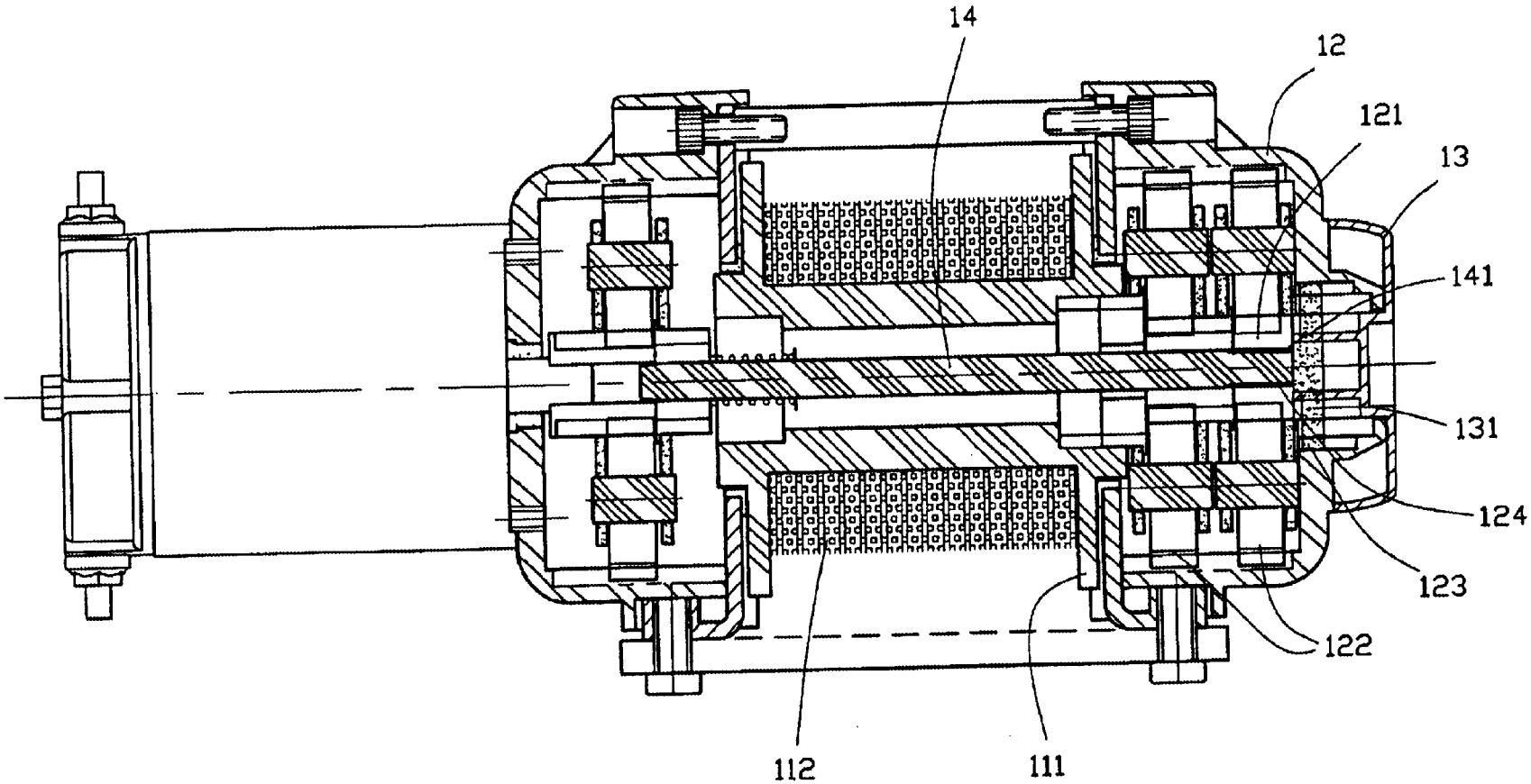
PRIOR ART FIG. 4
FIG. 4 is a sectional view showing the disengagement of the transmission shaft from the first sun gear of a conventional winch.
Figure 5:
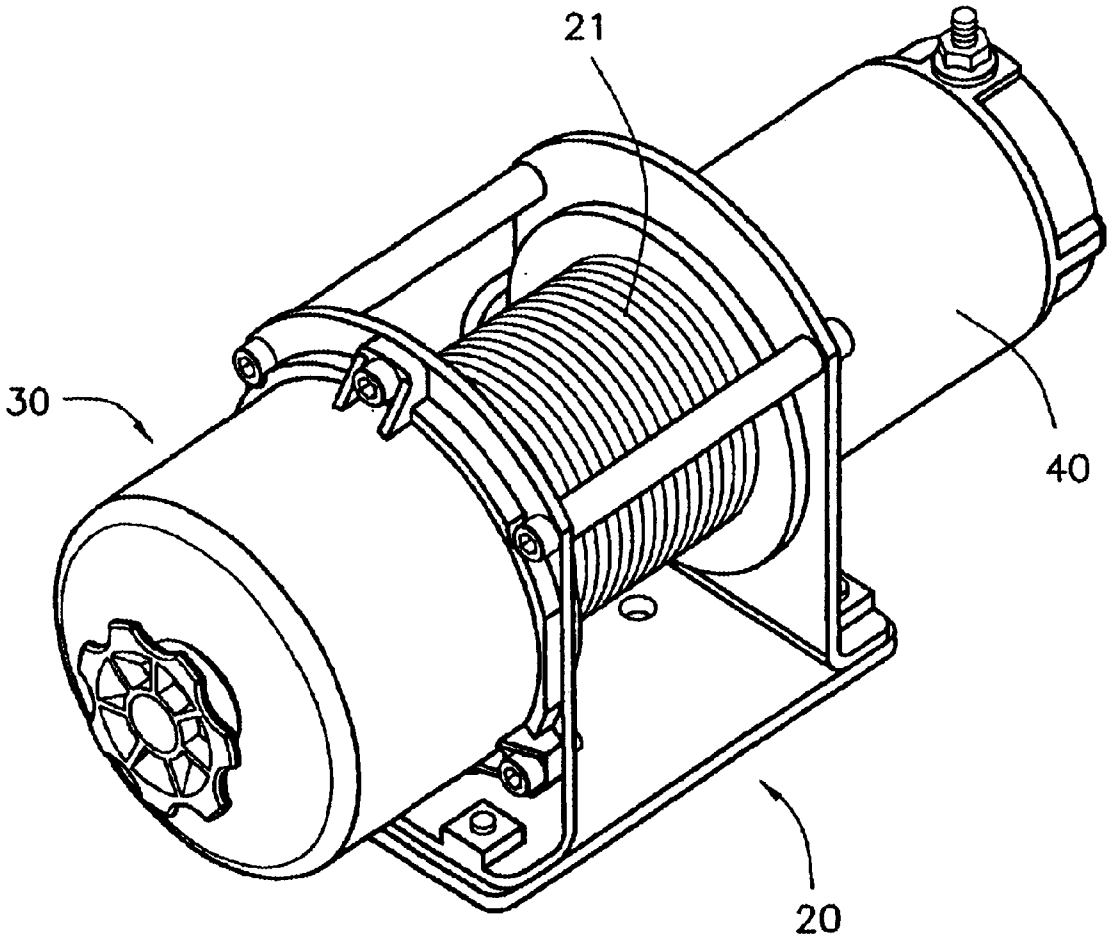
FIG. 5 is a perspective view of an improved structure of a cable winch used in vehicle of the preferred embodiment of the present invention.
Figure 6:
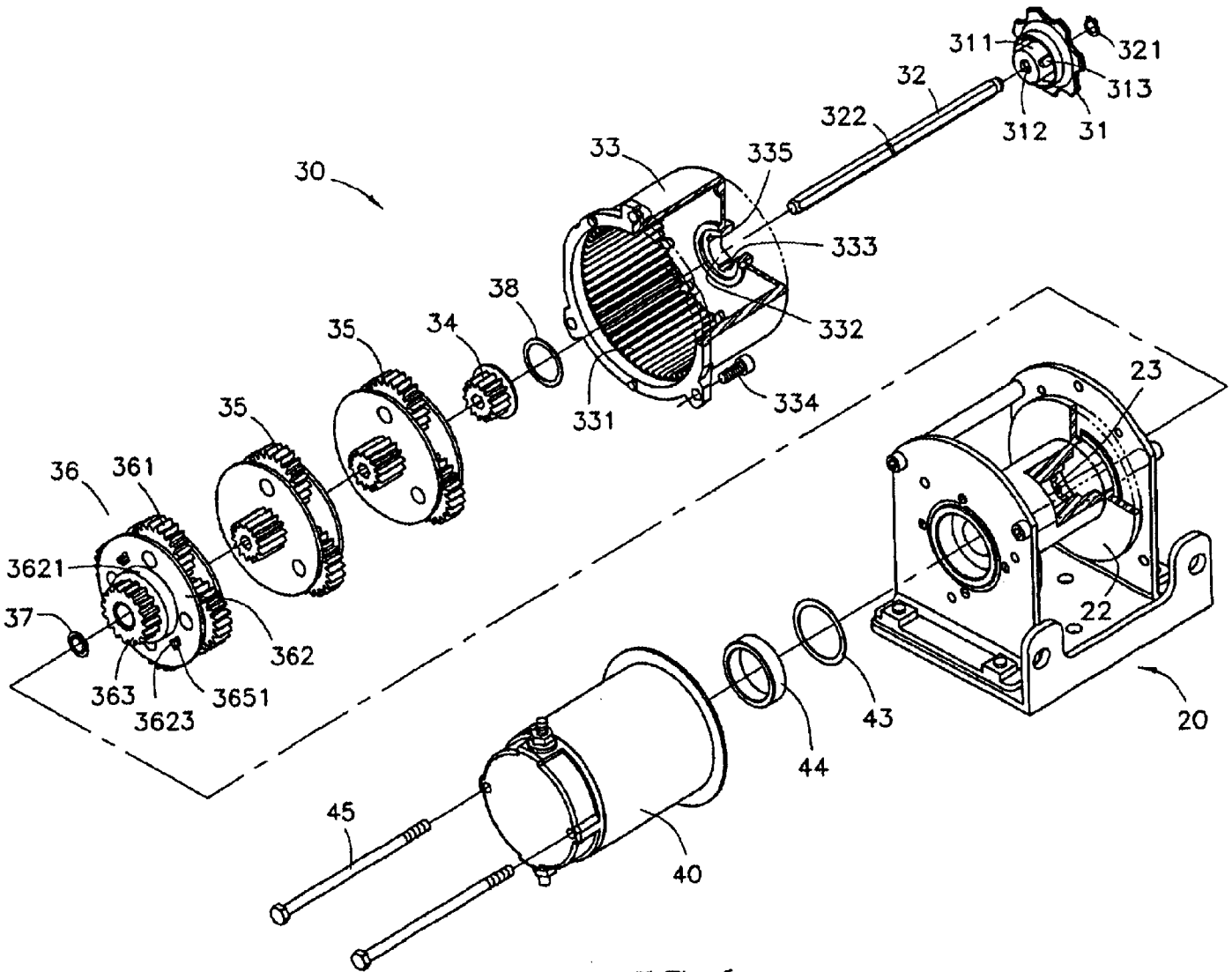
FIG. 6 is an exploded perspective view of an improved structure of a cable winch used in vehicle of the present invention.

Referring to FIGS. 5 and 6, there is shown an improved structure of a cable winch used in vehicle, comprising a rolling cylinder component 20 having one end being mounted with a speed-reducing device 30 and the other end being mounted with a motor 40 so as to transmit the power of the motor 40 to the rolling cylinder component 20 by the speed-reducing device 30. In accordance with the present invention, the speed-reducing device 30 includes a control button 31, a transmission shaft 32, a gear box 33, a sun gear 34, a plurality of planetary gear sets 35, a clutch and planet gear set 36, and a fastening ring 37, wherein the interior of the control button 31 is provided with a protruded tubular section 311 and the center of the tubular section 311 is provided with an inner hole 312, and the circumferential edge is arranged with protruded pegs 313; the transmission shaft 32 is a hexagonal rod body having one end being inserted into the inner hole 312 of the control button 31 using the fastening ring 321 and a recessed ring 322 is provided close to the middle section thereof; the interior of the gear box 33 is a cavity and the inner wall is provided with inner ring teeth 331, and the bottom surface being a through hole 332 and the inner circumferential edge of the through hole 332 is provided with a recess 333 to match with the protruded peg 313 of the control button 31. The sun gear 34 and the planet gear set 35 are obvious and further description thereof is not needed.

Figure 7:
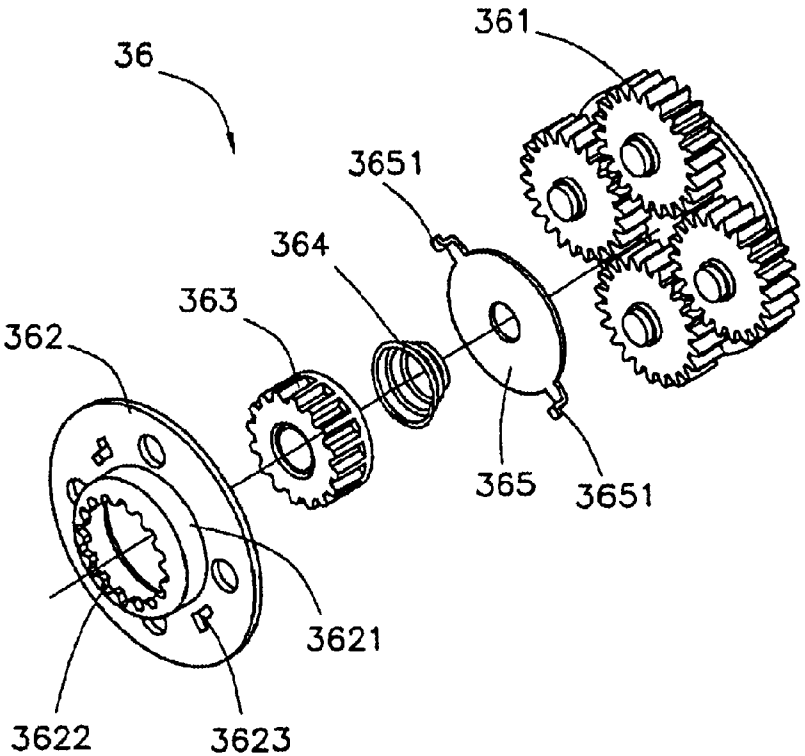
FIG. 7 is an exploded perspective view of the clutch and planet gear of the present invention.
Figure 9:
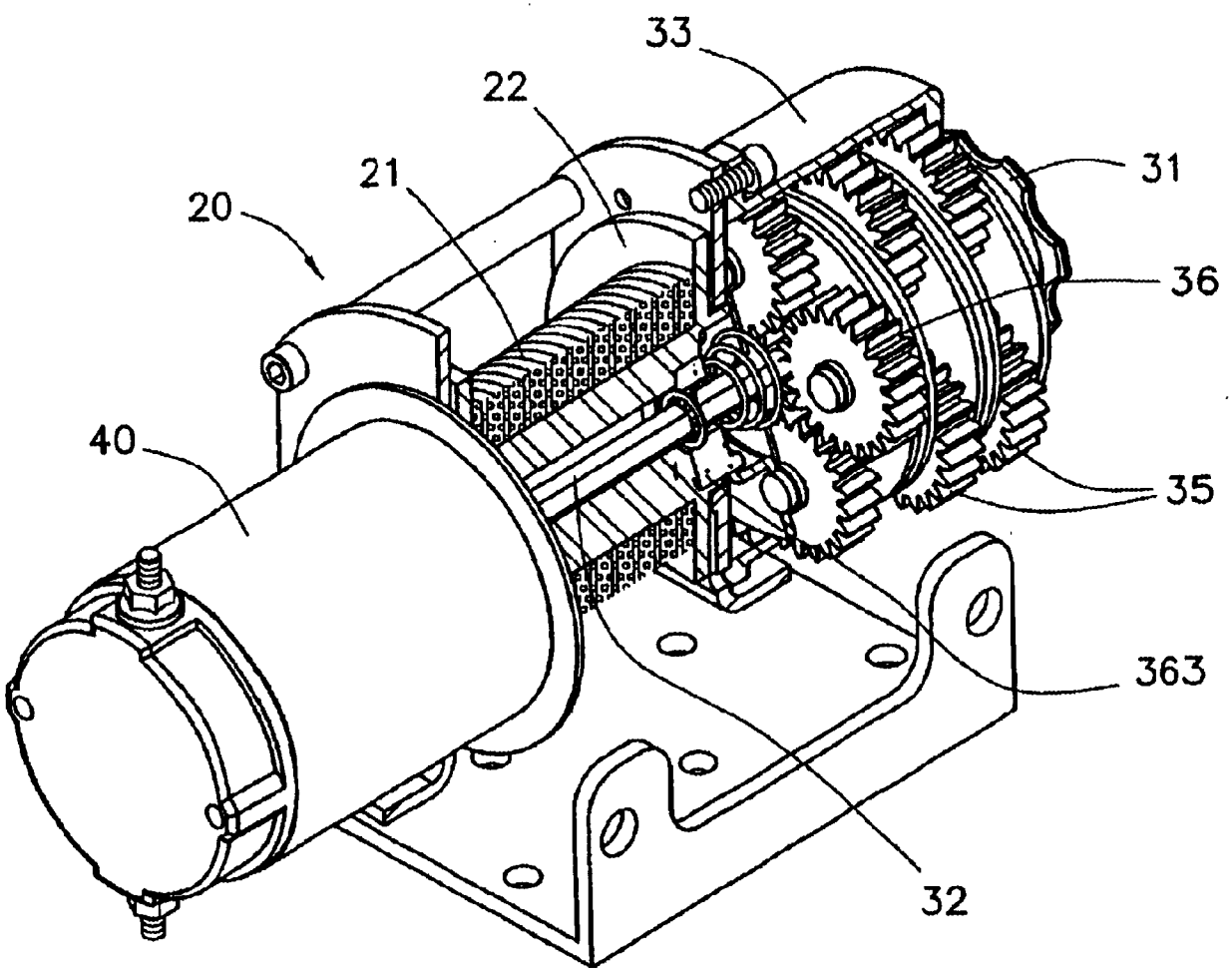
FIG. 9 is a perspective partial sectional view of an improved structure of a cable winch used in vehicle of the present invention.

Referring to FIGS. 6 and 7, the clutch and planet gear set 36 includes planet gear train 361, a front cover 362, a moving gear 363, a worm-like spring 364, and a fixing board 365, wherein the center of the front cover 362 is pressed into a protruded section 3621 surrounded with teeth hole 3622 and the board surface of the front cover 362 is provided with an engaging hole 3623, and the inner lateral face of the front cover 362 between the planet gear train 361 is provided with the moving gear 363 and the worm-like spring 364 using a fixing board 365 and the teeth hole 3622 of the front cover 362 and the moving gear 363 match with each other, so that the moving gear 363 is extendable and retractable within the protruded section 3621; the surface of the fixing board 365 is provided with crooked leg 3651 to mount with the engaging hole 362 of the front cover 362 so that the moving gear 363 and the worm-shaped gear 364 are mounted on the front cover 362.

Figure 8:
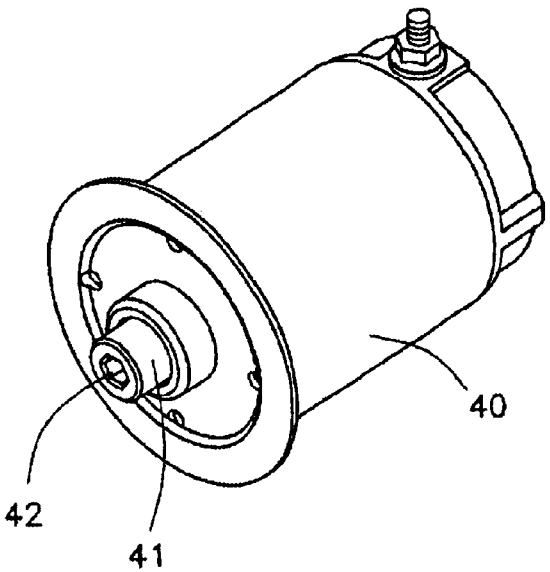
FIG. 8 is a perspective view of the motor of the present invention.

As shown in FIGS. 6 and 8, the center of the rotating shaft 41 of the motor 40 is a non-circular insertion hole 42 having an exterior diameter substantially the same as that of the transmission shaft 32.

The combination of the winch of the present invention is shown in is FIGS. 6 to 10. One end of the transmission shaft 32 is inserted into the inner hole 312 of the control button 31 and a fastening ring 321 is used to fasten. The tubular section 311 of the control button 31 is pivotally inserted into the through hole 332 position of the gear box 33 and the protruded peg 313 is matched to the recess 333 of the gear box 33. The transmission shaft 32 is mounted at the center of the gear box 33 and the transmission shaft 32 of the gear box 33 is then mounted in sequence with a corrugated pad 38, sun gear 34, a plurality of planetary gear set 35 and the clutch and planet gear set 36. A fastening ring 37 is used to fasten the moving gear 363 at the recess 322 of the transmission shaft 32. The sun gear 34 and the planetary gear set 35 and the clutch and planet gear 36 can accept the input power from the transmission shaft 32, and the planetary gear set 35 and the clutch and planet gear set 36 are in engagement and driven with the inner circular teeth 331 of the gear box 33 to form planetary gear-reducing device 30. The gear box 33 is locked at one end of the rolling cylinder 20 with screw bolt 334 and the moving gear 363 of the clutch and planet gear set 36 is in engagement with the teeth portion 23 of the rolling cylinder 22, and the transmission shaft 32 passes through the rolling cylinder 22. The other end of the rolling cylinder 20 is pivotally mounted to the rotating shaft 41 of the mounted with a corrugated pad and a seal 44 and a screw bolt 45 is used to lock the motor 40 to the other end of the rolling cylinder 20 and the insertion hole 42 of the rotating shaft 41 is in engagement with the end terminal of the transmission shaft 32 and obtain power output from the motor 40.

Figure 10:
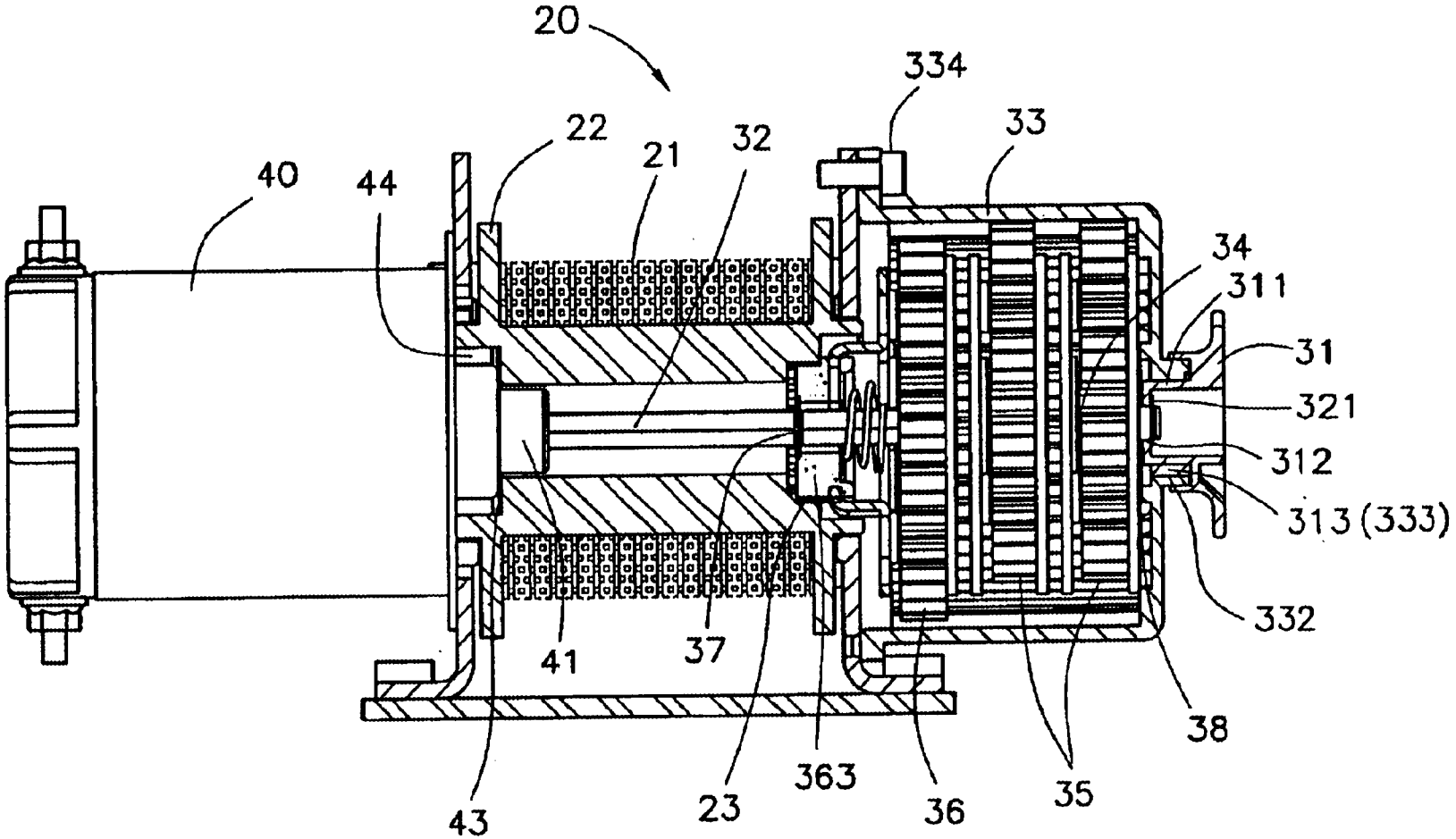
FIG. 10 is a sectional view of an improved structure of a cable winch used in vehicle of the present invention.—
Figure 11:
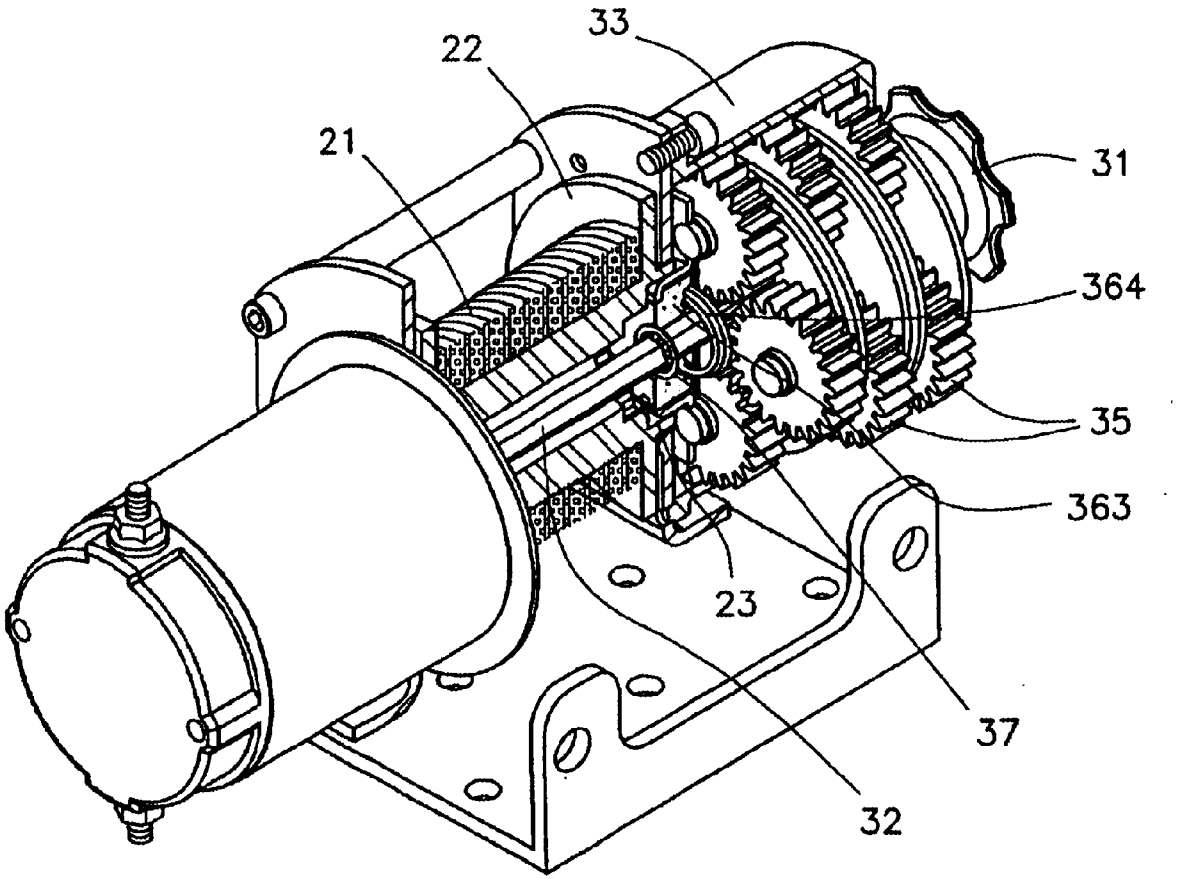
FIG. 11 is a sectional perspective view showing the clutch and planet gear disengaged from the gear box of an improved structure of a cable winch used in vehicle of the present invention.
Figure 12:
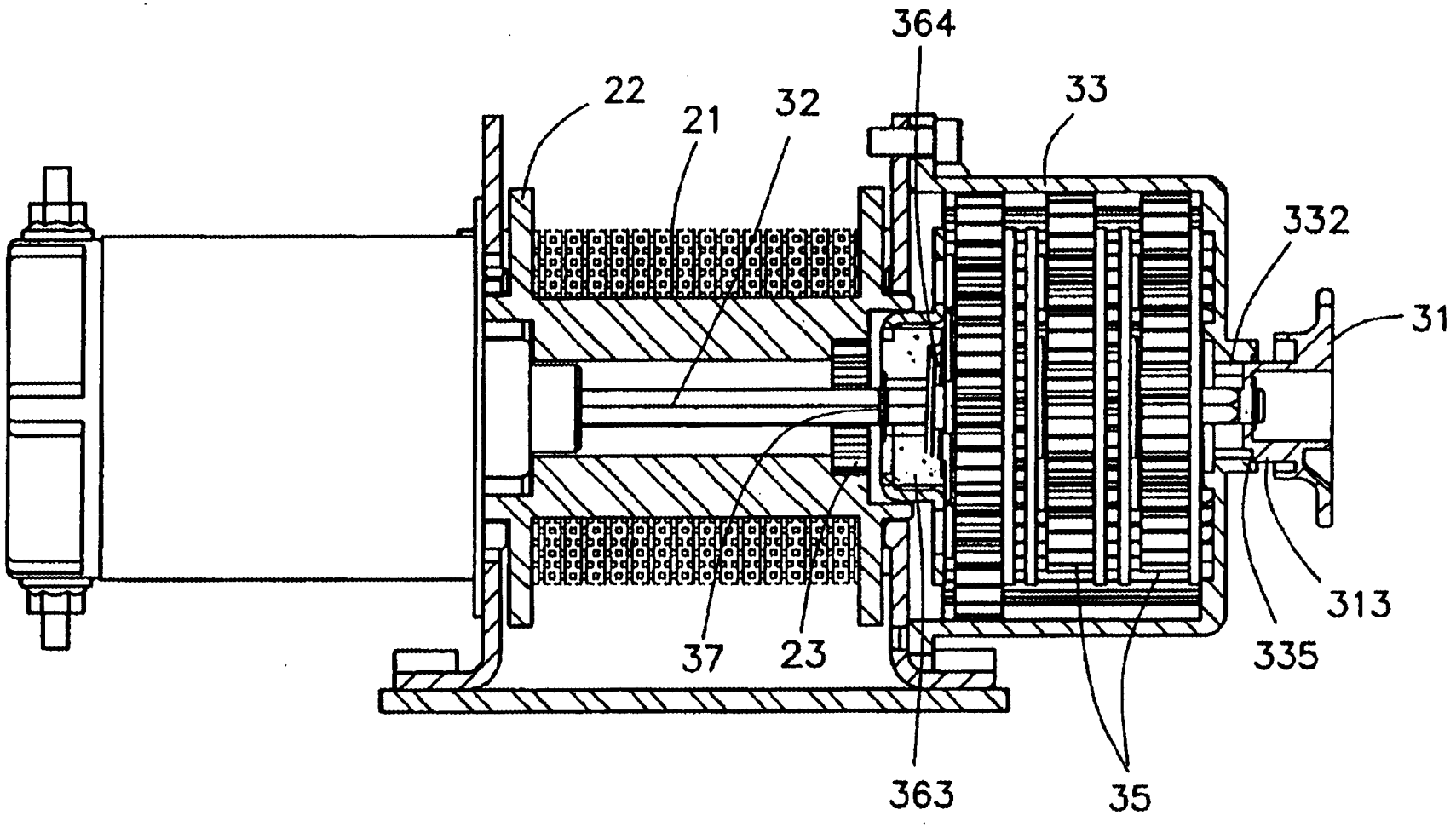
FIG. 12 is a sectional view showing the clutch and planet gear disengaged from the gear box of an improved structure of a cable winch used in vehicle of the present invention.

In accordance with the present invention, the operation of the winch is as follows:

(1) Rolling of the cable: As shown in FIG. 10, the motor 40 is turned on and the rotating shaft 41 drives the transmission shaft 32, the sun gear 34, the respective planetary gear set 35 and the clutch and planet gear set 36, the planetary type of gear speed-reducing rotation within the gear box 33 is obtained. At this instance, the moving gear 363 will drive the rolling cylinder 22 of the rolling cylinder set 20 for use in the rolling of cable 21. (II) Releasing of the cable 21: Referring to FIGS. 11 and 12, the control button 31 is rotated so that the protruded peg 313 urges the top edge 335 of the through hole 332 of the gear box 33, the control button 31 will drive the transmission shaft 32 and the fastening ring 37 to compress the moving gear 363 and the worm-like spring 364, and the moving gear 363 is disengaged from the teeth section of the rolling cylinder 22. Thus, the rolling cylinder 22 is disengaged from the clutch and planet gear set 36 and free to rotate, i.e., the cable 21 can be lightly, conveniently pulled out for use. If the control button 31 is released, the cable 21 will be returned to its original position, as shown in FIG. 10.

It will be envisioned that various substitutions and modifications of the preferred embodiment illustrated in the drawings and described above can be made without departing from the invention as defined in the claims. It will be understood that persons skilled in the art will envision various substitutions of functionally equivalent structure for the structural elements described without departing from the invention.

I claim:

1. An improved structure of a cable winch used in vehicle, comprising a rolling cylinder component having one end being mounted with a gear speed-reducing device and the other end being mounted with a motor so as to transmit the power of the motor to the rolling cylinder component by the gear speed-reducing device, and the speed-reducing device including a control button, a transmission shaft, a gear box, a sun gear, a plurality of planetary gear sets, a clutch and planet gear set, and a fastening ring, characterized in that:

the interior of the control button is provided with a protruded tubular section and the center of the tubular section is provided with an inner hole, and the circumferential edge thereof is arranged with protruded pegs;

the transmission shaft is a hexagonal rod body having one end being inserted into the inner hole of the control button using the fastening ring and a recessed ring is provided close to the middle section thereof; the bottom surface of the gear box is provided with a through hole and the inner circumferential edge of the through hole is provided with a recess to match with the protruded peg of the control button;

the clutch and planet gear set includes a planet gear train, a front coves a moving gear, a worm-like spring, and a fixing board, and the center of the front cover is pressed into a protruded section surrounded wit teeth hole and the board surface of the front cover is provided with an engaging hole and by means of the fixing board to mount the moving gear and the worm-like spring so that the moving gear is extendable and retractable within the protruded section of the front cover;

the surface of the fixing board is provided with crooked leg to correspond with the engaging hole of the front cover so that the moving gear and the worm-like spring are mounted on the front cover; and the center of a rotating shaft of the motor is provided a polygonal insertion hole with external diameter substantially the same as the transmission shaft, the transmission shaft is inserted into the inner hole of the control button and is locked with the fastening ring, and the tubular section of the control button is inserted at the position of the through hole of the gear box and the protruded peg of the control button is in alignment with the recess of the gear box and the transmission shaft is extended to the center of the gear box and in sequence the transmission shaft is mounted with a pad, the sun gear, a plurality of planetary gear sets and the clutch and planet gear set, thereby in releasing the cable, the control button is pulled and turned so that the protruded peg urges the top edge of the through hole of the gear box and the button pulls the transmission shaft and the fastening ring compresses the moving gear and the worm-like spring so that the moving gear disengages with a teeth section of the rolling cylinder, and the rolling cylinder is dislocated from the clutch and planet gear set and rotates freely, and the cable is refracted rapidly and conveniently.

* * * * *